United States Patent [19]

Whitmore

[11] Patent Number: 4,936,272

[45] Date of Patent: Jun. 26, 1990

[54] PRELUBE SYSTEM

[76] Inventor: Lee K. Whitmore, 281 Sargent, Buckley, Pierce County, Wash. 98321

[21] Appl. No.: 405,441

[22] Filed: Sep. 11, 1989

[51] Int. Cl.[5] ..... F01M 1/00

[52] U.S. Cl. ..... 123/196 S; 184/6.3

[58] Field of Search ..... 123/196 S, 189 A, 196 B; 184/6.3, 6.4

[56] References Cited

U.S. PATENT DOCUMENTS

| | | | |
|---|---|---|---|
| 3,066,664 | 12/1962 | McNew et al. | 123/196 S |
| 3,422,807 | 1/1969 | Waldecker | 123/196 S |
| 4,061,204 | 12/1977 | Kautz, Jr. | 123/196 S |
| 4,628,877 | 12/1986 | Sundles et al. | 123/196 S |
| 4,703,727 | 11/1987 | Cannon | 123/196 S |

*Primary Examiner*—E. Rollins Cross

*Attorney, Agent, or Firm*—James F. Leggett

[57] ABSTRACT

A combination of electrical, mechanical and hydraulic components specifically arranged in communication with the existing lubrication system of high performance internal combustion engines, such as are utilized in the motor home industry, so as to enable the pre-lubing of the moving parts of the engine before it is started or turned over, the components of which are existing items of manufacture and the combination can be readily installed by owners without expensive modifications to the engine, said prelube system being primarily comprised of the removal of engine oil from the oil pan sump, pressurization of the oil by an electrically-driven pump and reinsertion of the oil into the engine through a one-quarter inch pipe Tee adapter, placed between the oil-sender and the engine block at the end of the engine farthest away from the engine-driven oil pump, said prelube system being controlled by a manually-activated electrical switch on the dashboard of the vehicle.

10 Claims, 2 Drawing Sheets

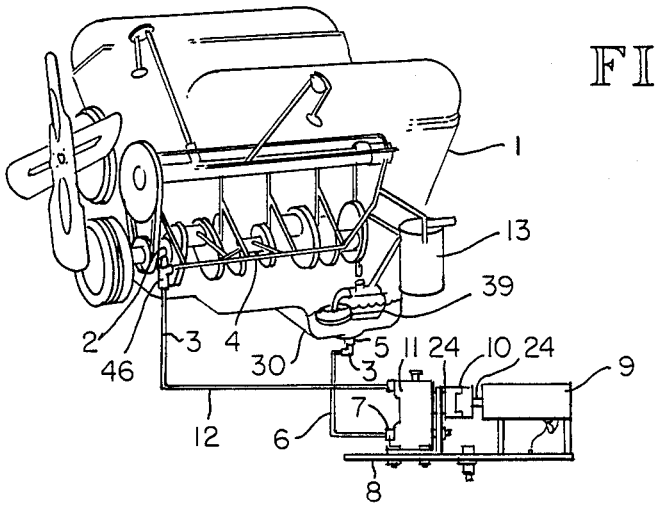
FIG. 1
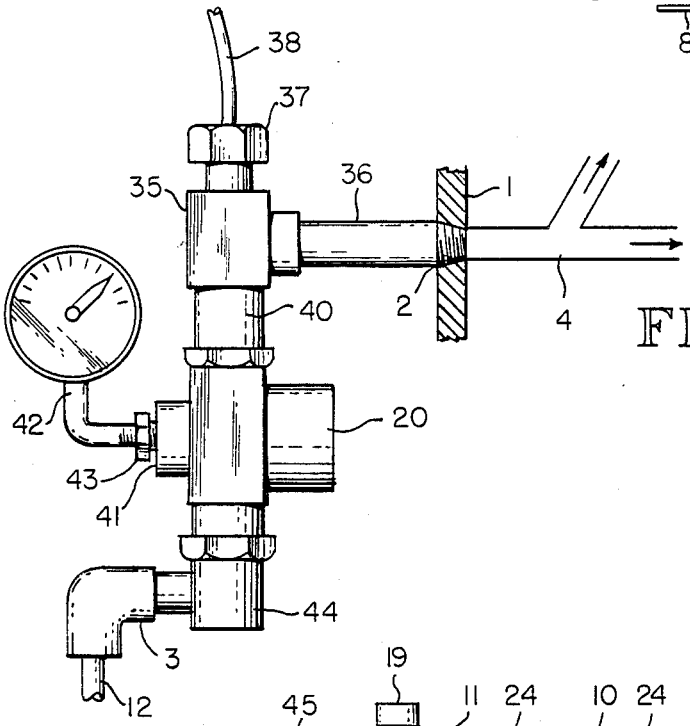
FIG. 2
FIG. 3
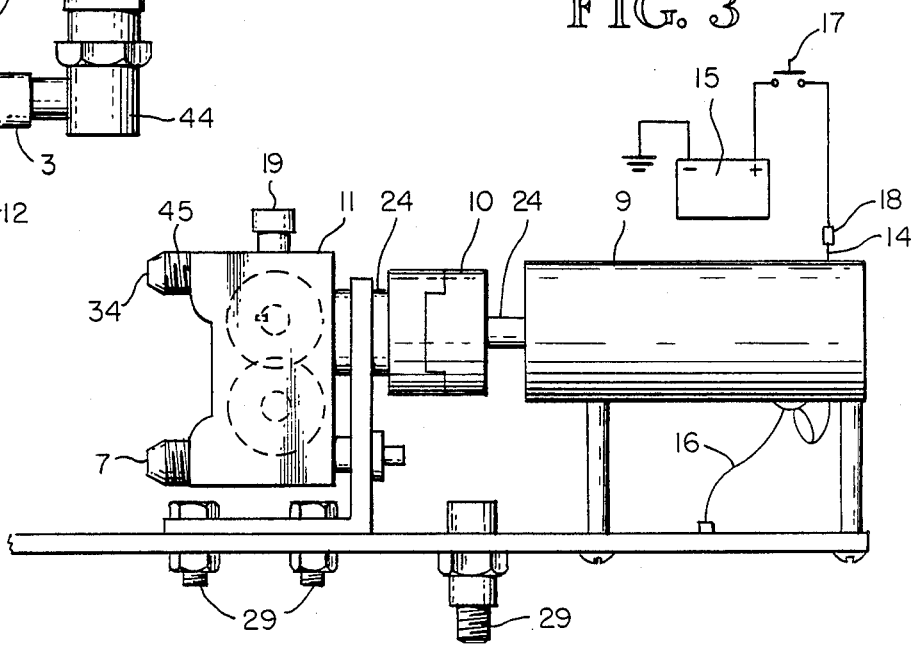

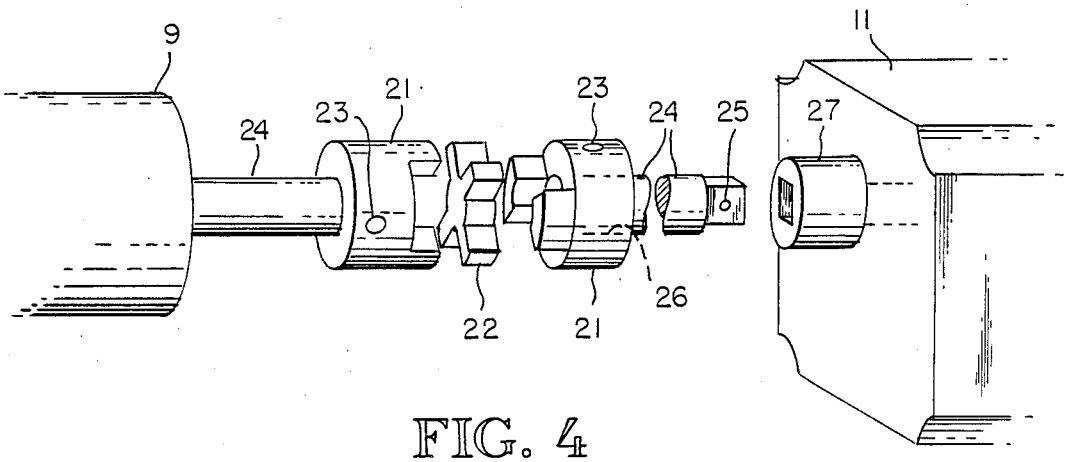
FIG. 4
FIG. 5
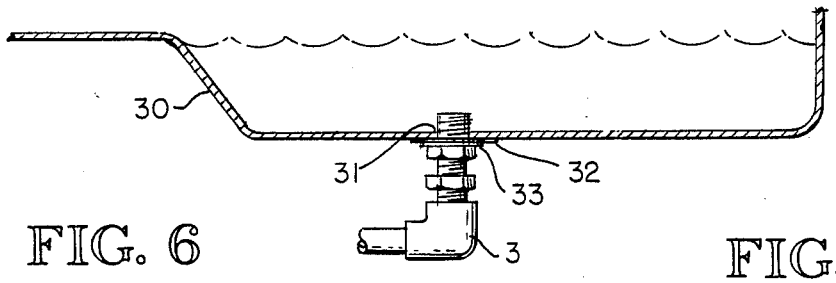
FIG. 6
FIG. 7
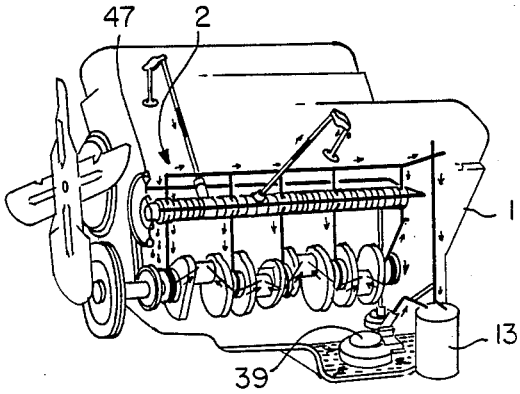
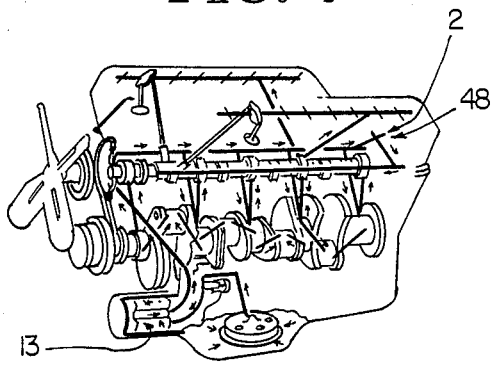
FIG. 8
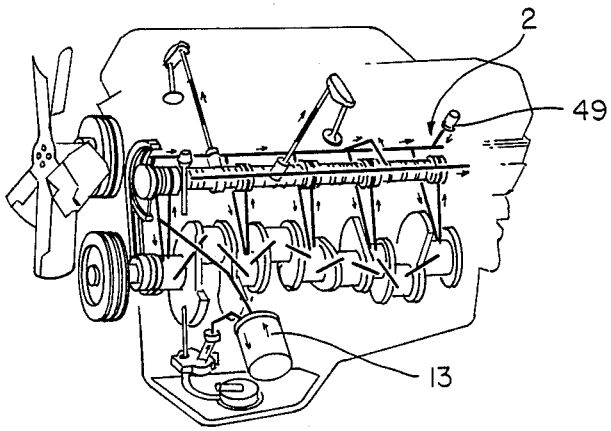

PRELUBE SYSTEM

BACKGROUND OF THE INVENTION

This invention relates generally to improvements in a prelube system for high performance internal combustion engines designed to minimize wear to engine components upon start after a period of non-operation. Numerous systems for accomplishing this objective have been patented over the years, including the following:

| U.S. Pat. No. | Inventor | Issue Date |
|---|---|---|
| 3,066,664 | D. J. McNew | Dec. 4, 1962 |
| 4,061,204 | W. C. Kautz, Jr. | Dec. 6, 1977 |
| 4,628,877 | Timothy B. Sundles | Dec. 16, 1986 |
| 3,422,807 | D. E. Waldecker | Jan. 21, 1969 |
| 3,425,404 | J. E. Lamkin | Feb. 4, 1969 |
| 4,703,727 | J. D. Cannon | Nov. 3, 1987 |
| 4,168,693 | L. J. Harrison | Sep. 25, 1979 |

While some of the elements of the foregoing patents perform similar functions to the elements of this invention, the previous patents require fabrication of special components and are not compatible with the high performance internal combustion engines utilized in the motor home industry. Although each has deficiencies that preclude its use with General Motors, Ford or Chrysler motor homes, such as Harrison's lack of a pressure relief valve in his pump and Cannon's elimination of the oil by-pass channel from the engine block access which voids the engine manufacturers' warranties, none provide a sufficient quantity of oil to the moving parts of the engine farthest away from the engine-driven oil pump at sufficient pressure nor are their electrical controls compatible with the electronic and/or computer-controlled ignitions utilized in modern motor homes.

The previous patents injected oil into the engine oil system at the end of the engine closest to the engine-driven oil pump. The modern high-performance internal combustion engines are equipped with an oil cooler at that end of the system which requires a substantial volume of oil to fill and substantial pressure to displace the air from the cooler and its lines through the engine. The subject invention avoids this by injecting oil into th engine at the point in the lubrication system farthest from the engine-driven oil pump and cooler.

The electronic and/or computer controlled ignition systems for modern high-performance internal combustion engines require positive signals from pressure sensors in the oil and fuel systems as well as the distributor, so that a pre-oiling system controlled in series with the ignition switch of the vehicle will not function, due to lack of a distributor signal, and the orange "check engine" default light will illuminate and can only be cleared by the dealer. Previous patents, such as Cannon and Harrison, have no override system to revert to the vehicle regular ignition system should the electronic ignition default or the supplemental oil supply of Cannon be exhausted before the engine starts.

Each of the previous patents have required original fabrication of at least some of its components and have not been readily installable by the average motor home owner. Thus, there has long existed a need for an inexpensive, self-installed pre-lube system for high-performance internal combustion engines, such as are utilized in the motor home industry, consisting of components readily available from existing stock.

BRIEF SUMMARY OF THE INVENTION

The subject invention satisfies the aforementioned needs by combining existing components, such as a small electric motor communicating to a small gear-driven pump via an anti-shock coupler, and using them to move oil from the engine's own oil pan sump, to pressurize it sufficiently to displace air in the engine lubrication system and to reinsert it into the engine oil system at the point furthest from the engine-driven oil pump. The subject invention is provided with electrical power from the vehicle battery and independently controlled by a manual switch so that it can be operated as long as necessary, i.e., where the engine has flooded on start or the vehicle has been inoperative for a long period of time in cold weather.

OBJECTS OF INVENTION

It is a primary object of this invention to provide an inexpensive kit for owners of motor homes, having high-performance internal combustion engines, either gasoline or diesel, to install themselves to reduce the wear on internal engine components associated with starting the engine after it has been inoperative for a sufficient period of time so that the oil in the galleys and on the moving surfaces has drained into the oil pan sump.

It is another object of this invention to provide a prelube system which is compatible with the electronic and/or computer controlled iqnition systems of modern high-performance internal combustion engines.

It is another object of this invention to route oil from the existing oil pan sump of the engine to the end of the engine farthest from the engine-driven oil pump at sufficient pressure to displace air that has occupied the lubrication system, so that the moving parts of the engine, especially those farthest from the engine- driven oil pump, are adequately lubricated before the engine is started or turned over.

It is still another object of this invention to eliminate the need for fabrication of any parts for the kit or to make any modifications to the engine in order to install and operate the prelube system.

It is yet another object of the invention to provide a system having sufficient oil supply, pressure and routing to adequately lubricate the moving parts of an engine equipped with an oil cooler.

The subject invention accomplishes these objectives by combining, in a new and novel way, existing components, such as a Detroit right-hand rotation pump P/N4199561, a Dayton totally enclosed non-vented ball bearing motor P/N 4Z145 joined with a Lovejoy anti-shock coupler P/N 1 A417 and spider P/N X409, which provide the mechanical means to move oil from the engine oil pan sump to the oil sender port in the engine block, where the oil pan sump and block meet on the front of the drivers side on General Motors 454 c.i.d. engines and in similar locations on other large internal combustion engines at the point on the driver's side farthest away from the engine-driven oil pump. The pump motor unit is installed by conventional bolt means on the frame rail with the pump toward the front of the vehicle. The factory oil pan plug is replaced with an oil pan plug adapter with copper gasket, so that the solid copper side is toward the oil pan, the other end mating with an hydraulic hose to carry oil to the pump. Pressurized oil from the pump travels through an hydraulic hose mated to the stem of a one-eighth inch pipe Tee adapter inserted between the oil sender and the engine block. Operation of the electric motor and pump is controlled by a two- position manually operated switch, such as NAPA Selecta Switch push button switch P/N S.S.519-BG, installed in the dashboard and wired in series between the vehicle battery and the electric motor.

All of the objectives of the invention can be thus accomplished because activation of the switch turns on the pump which delivers oil at 2.5 quarts per minute, of which about one-half will go in the engine because of the mechanical restriction therein, at from 25 to 45 psi. Operation of the pump can be adjusted from a normal period of one to two minutes to longer periods following non-operation of the engine in cold weather or during aborted attempts to start the engine, i.e., flooding. Operation or non-operation of the pump does not interfere with the normal electronic and/or computer controlled ignition sequence of the vehicle yet the operator can confirm operation of the pump by reference to the oil pressure gauge in the vehicle.

BRIEF DESCRIPTION OF THE SEVERAL VIEWS OF THE DRAWING

In the accompanying drawings:

FIG. 1 is a diagrammatic view of the prelube system as installed on a high performance internal combustion 454 c.i.d. engine.

FIG. 2 is a detailed view of the one-eighth inch pipe Tee adapter.

FIG. 3 is a view of the motor and pump as installed on the mounting plate.

FIG. 4 is a detailed view of the shock absorbing coupler assembly between the motor and the pump.

FIG. 5 is a detailed view to the oil pan plug adapter.

FIG. 6 is a schematic of the engine oiling system for V-8 283, 307, 327, and 350 engines showing the point of installation of the one-eighth inch pipe Tee adapter.

FIG. 7 is a schematic of the engine oiling system for V-8 361, 383, 413, 426, and 440 engines showing the point of installation of the one-eighth inch pipe Tee adapter.

FIG. 8 is a schematic of the engine oiling system for V-8 429 and 460 engines showing the point of installation of the one-eighth inch pipe Tee adapter.

DETAILED DESCRIPTION

Referring to the drawings and more particularly FIG. 1 thereof, the prelube system is shown as installed on a General Motors 454 c.i.d. internal combustion engine (1) equipped with an oil cooler (13). The prelube system is composed of an electrically-driven motor (9), such as a Dayton DC motor model number 4Z145, which is electrically connected by standard wire means (14) to the vehicle battery (15) and powered thereby, being grounded to the vehicle frame by standard wire means (16), and whose operation is controlled by a switch (17), such as an E/C switch number 213 or a Selecta switch 519-BG, installed in the dashboard of the vehicle by standard screw means, with the electrical circuit thereof being completely isolated from the electronic and/or computer controlled vehicle ignition system and protected by a 20 amp in-line fuse assembly (18), such as NAPA p/n 7821110, which motor (9) is operatively coupled to a mechanical gear drive pump (11), such as a Detroit right- or left-hand fuel pump model number 4199561, casting number 5113776-M, having a standard vent (19) and a pressure relief valve (2) set at 65 psi, located in its outlet line to the engine, so as to pressurize the engine's crankshaft journals (4) between 25 and 45 psi of oil pressure, by means of shock absorbing coupler assembly (10) (see FIG. 4), such as two Lovejoy coupling bodies 1A417 (21), equipped with a hollow head set screw (23) for secure attachment to the drive shafts (24) of the pump and the motor, and Lovejoy coupling spider 1×409 (22) interposed between the two couplers, said shock absorbing coupler assembly (FIG. 4) being mechanically connected to the pump (11) by suitable means, such as the end of an American Vermont one-quarter-inch power socket adapter, number 15471(3171), having the receptacle for a snap-on socket (25) and having its length cut down so as to exactly communicate with the center hole (26) in the Lovejoy coupler (21) and mechanically connected to a one-quarter-inch drive 8-point socket, Snap-On TM-410 (27), so as to mechanically communicate with the drive shaft (28) of the pump (11), this pump hydraulically communicating with the engine oil lubrication system by means of lines and adapters as described below.

The pump (11) and motor (9) mechanically joined as set forth above and attached to a mounting plate (8), such as a three-sixteenth-inch steel plat twelve inches long and three-and-one-half inches wide and mounted to the frame of the vehicle above the level of the oil pan sump (30) by standard bolt means (29).

The shock absorbing coupler assemby (10), as described above and in FIG. 4 provides the means to reduce wear on the motor and pump via the shock-absorbing spider (22).

The pump 11) draws oil into its inlet port (7) through the Aeroquip FC-300 suitable length of hydraulic hose (6) fitted with a JIC 37 degree fitting (3) which communicates by threaded means to the oil pan plug adapter (5) (see FIG. 5), such as a B & M transmission drain pluq kit (31) with a General Motors oil pan plug gasket (32), p/n 14090908, and an optional copper washer (33), p/n 56030, as shown in FIG. 5.

The pump (11) outlet port (34) communicates by standard threaded means with a suitable length of Aeroquip FC-300 hydraulic hose (12) fitted with a JIC 37 degree fitting (3) which communicates by similar threaded means with the one-eighth inch pipe Tee adapter means (46) as shown in FIG. 2 installed on a General Motors 454 c.i.d. engine. Said pipe Tee adapter, having a one-eighth-inch brass tee female (35), communicates with the engine crankshaft journal (4) through a one-and-one-quarter-inch steel pipe-nipple (36) inserted into the engine block (1) by standard threaded means through the port provided for on engine component (2), such as the oil pressure sending unit (37) having one wire (38) attached thereto for the General Motors 454 c.i.d. engine, located at the end of the engine lubrication system (4) furthest away from the engine-driven oil pump (39), which component is reinstalled into the engine oil lubrication system by insertion into the top of the one-eighth inch brass tee female (35). The leg of this one-eighth inch brass tee female opposite to the reinstalled engine component (37) communicates by standard threaded means to a one-eighth-inch to one-quarter-inch pipe adapter (40) which communicates by standard threaded means with the outlet side of a one-quarter-inch check valve (20), such as Bronze Air one-quarter-inch check valve model number CB-25, having a port (41) for an optional oil pressure gauge (42) which port is filled with a one-eighth-inch pipe plug (43) if a gauge is not installed, and a 90-degree one-quarter-inch pipe to five-sixteenth-inch tubing fitting being inserted into the inlet side of said check valve (44) by standard threaded means and to which is attached by similar threaded means the JIC 37 degree fitting (3) from the length of Aeroquip FC-300 hydraulic hose (12) which communicates with and is attached to the outlet port of the pump (34) by standard threaded means through a one-quarter-inch pipe to five-sixteenth-inch tubing adapter (45).

FIGS. 6, 7 and 8 show the oil lubrication systems of other high-performance internal combustion engines to which the prelube system is applicable. FIG. 1 showed the V-8 engine series, to include the 366, 396, 427 and 454 c.i.d. engines, wherein the prelube system one-eighth inch pipe Tee adapter means (46) is inserted into the engine port (2) for the oil transfer sensor (37) at the bottom of the engine block (1).

FIG. 6 shows the V-8 engine series, to include the 283, 307, 327 and 350 c.i.d. engines, wherein the prelube system one-eighth inch pipe Tee adapter means (46) is inserted into the engine port (2) for the oil transfer sensor (47) at the top of the engine block (1).

FIG. 7 shows the V-8 engine series, to include the 361, 383, 413, 426 and 440 c.i.d. engines, wherein the prelube system one-eighth inch pipe Tee adapter means (46) is inserted into the engine port (2) for the oil pressure gauge (48) on the top rear of the engine.

FIG. 8 shows the V-8 engine series, to include the 429 and 460 c.i.d. engines, wherein the prelube system one-eighth inch pipe Tee adapter means (46) is inserted into the engine port for the low pressure warning light (49) on the top rear of the engine block (1).

While this invention has been shown and described with reference to a preferred embodiment thereof, it will be understood by those skilled in the art that various changes in form and detail may be made therein without departing from the spirit and scope of the invention, such as its use in combination with gasoline- or diesel-powered internal combustion engines other than those listed herein or in applications other than the motor home industry.

I claim:

1. A prelube system for installation on high performance internal combustion engines of the type utilized in the motor home industry, equipped with oil coolers and electronic and/or computer controlled ignitions, composed of a combination of:

an electrically driven motor of suitable capacity, electrically connected by standard wire means to and powered by a vehicle battery and activated by a switch of suitable means, mounted on a vehicle dashboard, isolated from a vehicle electronic and/or computer controlled ignition system;

a mechanical gear drive pump of suitable capacity, operatively coupled to the electrically-driven motor by a shock absorbing coupler assembly;

a mounting plate of suitable dimensions for affixing the pump and motor assembly to a vehicle frame above the level of an oil pan sump by standard bolt means;

an oil pan plug adapter having a center channel to allow oil from an oil pan sump to flow to the Aeroquip FC-300 hydraulic hose through an JIC 37 degree fitting, with which said hose is affixed to said oil pan plug adapter and into a pump inlet port:

an one eighth-inch pipe Tee adapter means, inserted into a engine block by standard threaded means, so as to communicate with an engine lubrication system at the opposite end of the engine from an engine-driven oil pump, having a fitting, to which is fixedly attached, by a JIC 37 degree fitting, a length of Aeroquip FC-300 hydraulic hose which communicates with a mechanical gear drive pump outlet port, being comprised of a one-and-one-fourth-inch long by one-eighth-inch diameter steel pipe-nipple, one end being inserted into the engine block and the other end inserted into the one-eighth-inch brass tee female having an open port for connection of the engine component link removed to allow insertion of the one and one-fourth-inch long by one-eighth-inch steel pipe-nipple and the opposite port communicating by standard threaded means through a one-eighth to one-quarter inch pipe adapter to the outlet side of a one-quarter inch check valve having an optional oil pressure port to the Aeroquip FC-300 hydraulic hose, via a ninety-degree one-quarter inch pipe to five-sixteenth inch tubing which is attached by standard threaded means to the JIC 37 degree fitting on the length of Aeroquip FC-300 hydraulic hose.

2. The prelube system as claimed in claim 1, wherein the electrically-driven motor of suitable capacity is a Dayton DC motor model number 4Z145.

3. The prelube system as claimed in claim 1, wherein the switch means of activating the electrically-driven motor with power from the vehicle battery is an E/C switch number 213 or a Selecta switch 519-BG installed in the dashboard of the vehicle by standard screw means and electrically communicating in series between the vehicle battery and the electrically-driven motor with the circuit thereof protected by a 20 amp in-line fuse assembly of suitable means, such as NAPA p/n 7821110.

4. The prelube system as claimed in claim 1, wherein the mechanical gear drive pump of suitable capacity is a Detroit right-or left-hand fuel pump model number 4199561, casting number 5113776-M, having a standard pressure relief valve set at 65 psi so as to pressurize the engine's crankshaft journals between 25 and 45 psi of oil pressure.

5. The prelube system as claimed in claim 1, used in combination with engine lubrication systems for V8-283, 307, 327, 350, 396, 427 and 454 engines, wherein the engine component removed from the engine block to allow insertion of the one-eighth-inch pipe Tee adapter is the oil pressure sending unit having one wire attached thereto and located just above where the block meets the oil pan sump on the front of the driver's side, said engine component being reinstalled into the open port on the one-eighth-inch brass tee female.

6. The prelube system as claimed in claim 1, used in combination with engine lubrication systems for V8-361, 383, 413, 426 and 440 engines, wherein the engine component removed from the engine block to allow insertion of the one-eighth-inch pipe Tee adapter in the line to the oil pressure gauge, said line being reinstalled into the open port on the one-eighth-inch brass tee female.

7. The prelube system as claimed in claim 1, used in combination with engine lubrication systems for V8-429 and 460 engines, wherein the engine component removed from the engine block to allow insertion of the one-eighth-inch pipe Tee adapter is the line to the low pressure warning light, said line being reinstalled into the open port on the one-eighth-inch brass tee female.

8. The prelube system as claimed in claim 1 wherein the oil pan plug adapter is a B & M drain plug kit with a General Motors oil pan plug gasket, p/n 14090908, and an optional copper washer, p/n 56030.

9. The prelube system as claimed in claim 1 wherein the one-eighth-inch pipe Tee adapter means is comprised of a one-and-one-fourth by one-eighth-inch steel pipe nipple, one end affixed by standard threaded means to the one-eighth-inch brass tee female, one port having installed the engine component, removed to allow installation of the end of the one-eighth-inch steel pipe nipple opposite to the one-eighth-inch brass tee female and the opposing port having installed a one-eighth to one-quarter-inch pipe adapter, p/n 2083-4-2S, which communicates to and is inserted by standard thread means into one end of an one-fourth-inch Bronze Air check valve, model number CB-25, having a port for an optional oil pressure gauge or filled with a one-eighth-inch pipe plug, if one is not installed, into which check valve's opposite end is inserted by standard thread means a ninety-degree one-quarter inch pipe to five-sixteenth inch tubing fitting, p/n 2024-4-5S, to which is attached by standard threaded means the JIC 37 degree fitting from the length of Aeroquip FC-300 hydraulic hose.

10. The prelube system as claimed in claim 1, where in the shock absorbing coupler assembly is comprised of two Lovejoy coupling body 1A417, equipped with a hollow head set screw for secure attachment to the drive shafts of the pump and motor with a Lovejoy coupling spider 1×409 interposed between the two Lovejoy coupling bodies, one said coupler being mechanically connected to the pump by suitable means, such as the end of an American Vermont one-quarter inch power socket adapter, #15471(3171), having the receptacle for a Snap-On socket, and having its length cut sown so as to exactly communicate with the center hole in the Lovejoy coupler body and mechanically connected to a one-quarter inch drive 8 point socket, Snap-On TM-410, so as to mechanically communicate with the drive shaft of the pump.

* * * * *